US007540594B2

(12) United States Patent
Coffey et al.

(10) Patent No.: US 7,540,594 B2
(45) Date of Patent: Jun. 2, 2009

(54) PRINTHEAD ASSEMBLY HAVING VERTICALLY OVERLAPPING INK FLOW CHANNELS

(75) Inventors: Johnnie Coffey, Winchester, KY (US); Steven Robert Komplin, Lexington, KY (US); Christopher Elliot Lingle, Lexington, KY (US)

(73) Assignee: Lexmark International, Inc.

( * ) Notice: Subject to any disclaimer, the term of this patent is extended or adjusted under 35 U.S.C. 154(b) by 527 days.

(21) Appl. No.: 11/426,978

(22) Filed: Jun. 28, 2006

(65) Prior Publication Data

US 2008/0043071 A1 Feb. 21, 2008

(51) Int. Cl.
*B41J 2/05* (2006.01)

(52) U.S. Cl. ..... 347/65; 347/66

(58) Field of Classification Search ..... 347/40, 347/42, 49, 63, 65, 66
See application file for complete search history.

(56) References Cited

U.S. PATENT DOCUMENTS 6,068,367 A * 5/2000 Fabbri ..... 347/49
6,250,738 B1 * 6/2001 Waller et al. ..... 347/42
6,350,013 B1 * 2/2002 Scheffelin et al. ..... 347/49
6,729,713 B2 * 5/2004 Shirakawa ..... 347/43
6,766,817 B2 7/2004 da Silva
6,918,404 B2 7/2005 da Silva
7,066,586 B2 6/2006 da Silva

OTHER PUBLICATIONS

Dias da Silva, Elson, e-mail transmission to Ryan L. Willis dated Monday, Mar. 31, 2008, 3:06 PM, Subject: Requesting IDS of US 6,766,817 for patents on porosity by Unsaturated Hydraulic Flow.

* cited by examiner

*Primary Examiner*—Anh T. N. Vo
(74) *Attorney, Agent, or Firm*—Taylor & Aust, PC

(57) ABSTRACT

A printhead body for mounting a micro-fluid ejection chip includes a floor having an interior side and an exterior side, the exterior side being configured for mounting at least one micro-fluid ejection chip. A plurality of body vias extends through the floor from the interior side to the exterior side. The plurality of body vias is positioned to supply ink to each micro-fluid ejection chip. A plurality of ink flow channels is formed over the interior side of the floor. The plurality of ink flow channels include at least a first ink flow channel vertically overlapping a separate and independent second ink flow channel. Each individual ink flow channel of the plurality of ink flow channels is in fluid communication with at least one body via of the plurality of body vias.

19 Claims, 7 Drawing Sheets

PRINTHEAD ASSEMBLY HAVING VERTICALLY OVERLAPPING INK FLOW CHANNELS

FIELD OF THE INVENTION

The present invention relates to an imaging apparatus, and, more particularly, to a printhead assembly having vertically overlapping ink flow channels.

BACKGROUND OF THE INVENTION

An imaging apparatus, such as an ink jet printer, forms an image on a print medium, such as paper, by applying ink to the print medium. The ink may be contained in one or more replaceable supply cartridges. Examples of such replaceable supply cartridges include a replaceable ink tank and an ink jet printhead cartridge. An ink jet printhead cartridge, for example, includes both an ink tank and a printhead having an ink jet micro-fluid ejection device. One known method of manufacturing a printhead cartridge is to use a three piece mold.

In contrast to the ink jet printhead cartridge, a replaceable ink tank does not include the micro-fluid ejection device. For example, one type of ink jet printer includes an on-carrier ink tank system that mounts a plurality of ink tanks, with each ink tank containing a supply of a particular color of ink, e.g., black, cyan, magenta, and yellow, to a printhead assembly separately mounted to the printhead carrier. In this case, the micro-fluid ejection device forms part of a printhead assembly and is not permanently attached to the ink tank. In an on-carrier ink tank system, the ink is transferred from the ink tank to the micro-fluid ejection device through as series of fluid interfaces, e.g., a felt ink retaining member located in the ink tank and a wick located on the printhead assembly.

SUMMARY OF THE INVENTION

The invention, in one form thereof, is directed to a printhead body for mounting a micro-fluid ejection chip. The printhead body includes a floor having an interior side and an exterior side, the exterior side being configured for mounting at least one micro-fluid ejection chip. A plurality of body vias extends through the floor from the interior side to the exterior side. The plurality of body vias is positioned to supply ink to each micro-fluid ejection chip. A plurality of ink flow channels is formed over the interior side of the floor. The plurality of ink flow channels include at least a first ink flow channel vertically overlapping a separate and independent second ink flow channel. Each individual ink flow channel of the plurality of ink flow channels is in fluid communication with at least one body via of the plurality of body vias.

The invention, in another form thereof, is directed to a printhead assembly for mounting to an imaging apparatus. The printhead assembly includes at least one micro-fluid ejection chip, and a printhead body to which each micro-fluid ejection chip is mounted. The printhead body includes a ceiling and a floor spaced apart from the ceiling. The floor has an interior side and an exterior side, the exterior side being configured for mounting each micro-fluid ejection chip. A plurality of body vias extends through the floor from the interior side to the exterior side. The plurality of body vias is positioned to supply ink to each micro-fluid ejection chip. A plurality of ink flow channels is formed over the interior side of the floor. The plurality of ink flow channels include at least a first ink flow channel vertically overlapping a separate and independent second ink flow channel. Each individual ink flow channel of the plurality of ink flow channels is in fluid communication with at least one body via of the plurality of body vias.

The invention, in another form thereof, is directed to a method for manufacturing a printhead body. The method includes molding into the printhead body a plurality of ink flow channels using a slide mold, the plurality of ink flow channels including at least a first ink flow channel vertically overlapping a separate and independent second ink flow channel. The plurality of ink flow channels is located to be in fluid communication with a plurality of body vias, wherein each individual ink flow channel of the plurality of ink flow channels is in fluid communication with at least one body via formed in the printhead body.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DESCRIPTION OF THE PREFERRED EMBODIMENT

Figure 1:
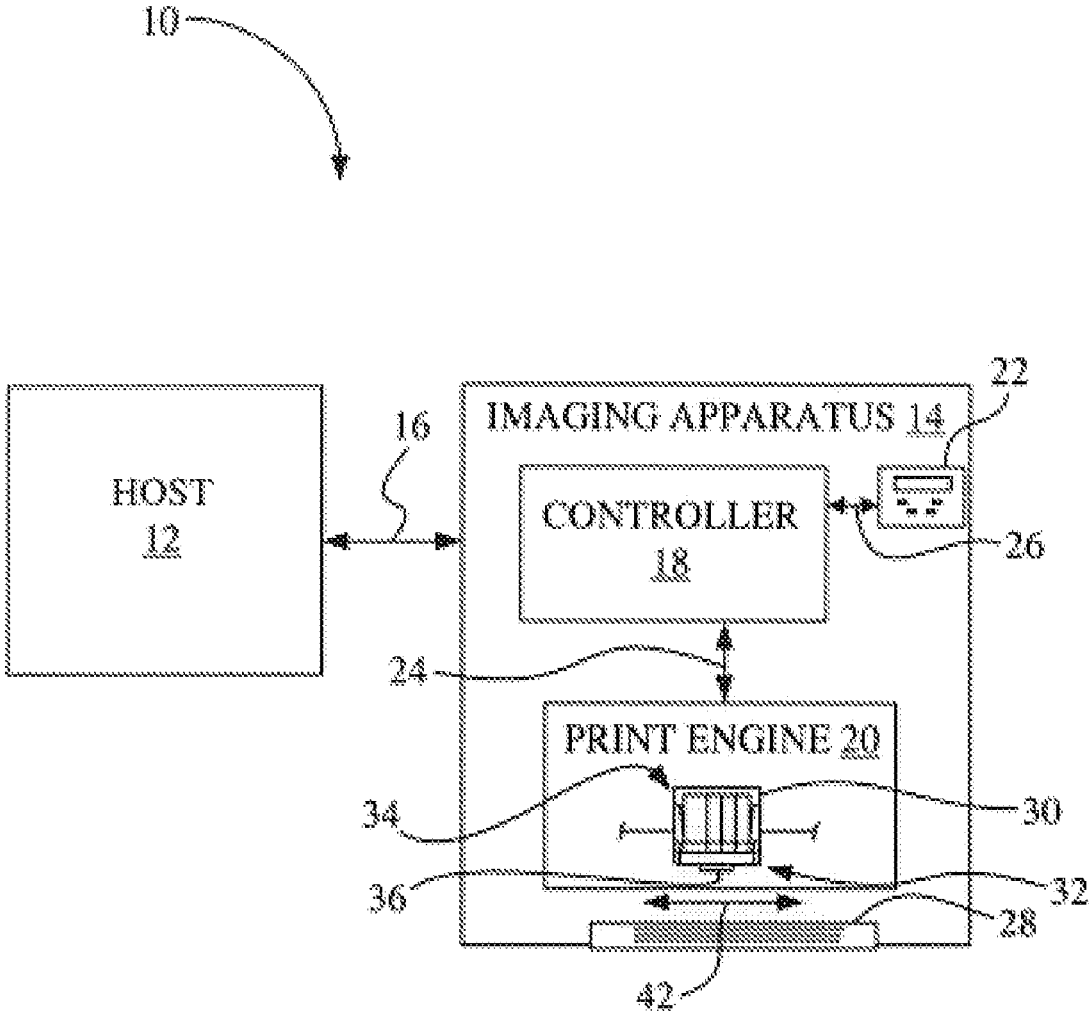
FIG. 1 is a diagrammatic depiction of an imaging system embodying the present invention.

Referring to FIG. 1, there is shown a diagrammatic depiction of an imaging system 10 embodying the present invention. Imaging system 10 may include a host 12 and an imaging apparatus 14. Imaging apparatus 14 communicates with host 12 by way of a communication link 16. Communications link 16 may be established by a direct cable connection, wireless connection or by a network connection such as for example an Ethernet local area network (LAN). As used herein, the term "imaging apparatus" is a device that forms a printed image on a print medium.

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including programs instructions that function as an imaging driver, e.g., printer driver software, for imaging apparatus 14. Alternatively, the imaging device may be incorporated, in whole or in part, in imaging apparatus 14.

In the embodiment of FIG. 1, imaging apparatus 14 includes a controller 18, a print engine 20 and a user interface 22.

Controller 18 includes a processor unit and associated memory, and may be formed as an Application Specific Integrated Circuit (ASIC). Controller 18 communicates with print engine 20 by way of a communications link 24. Controller 18 communicates with user interface 22 by way of a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a reciprocating printhead carrier 30.

Figure 2:
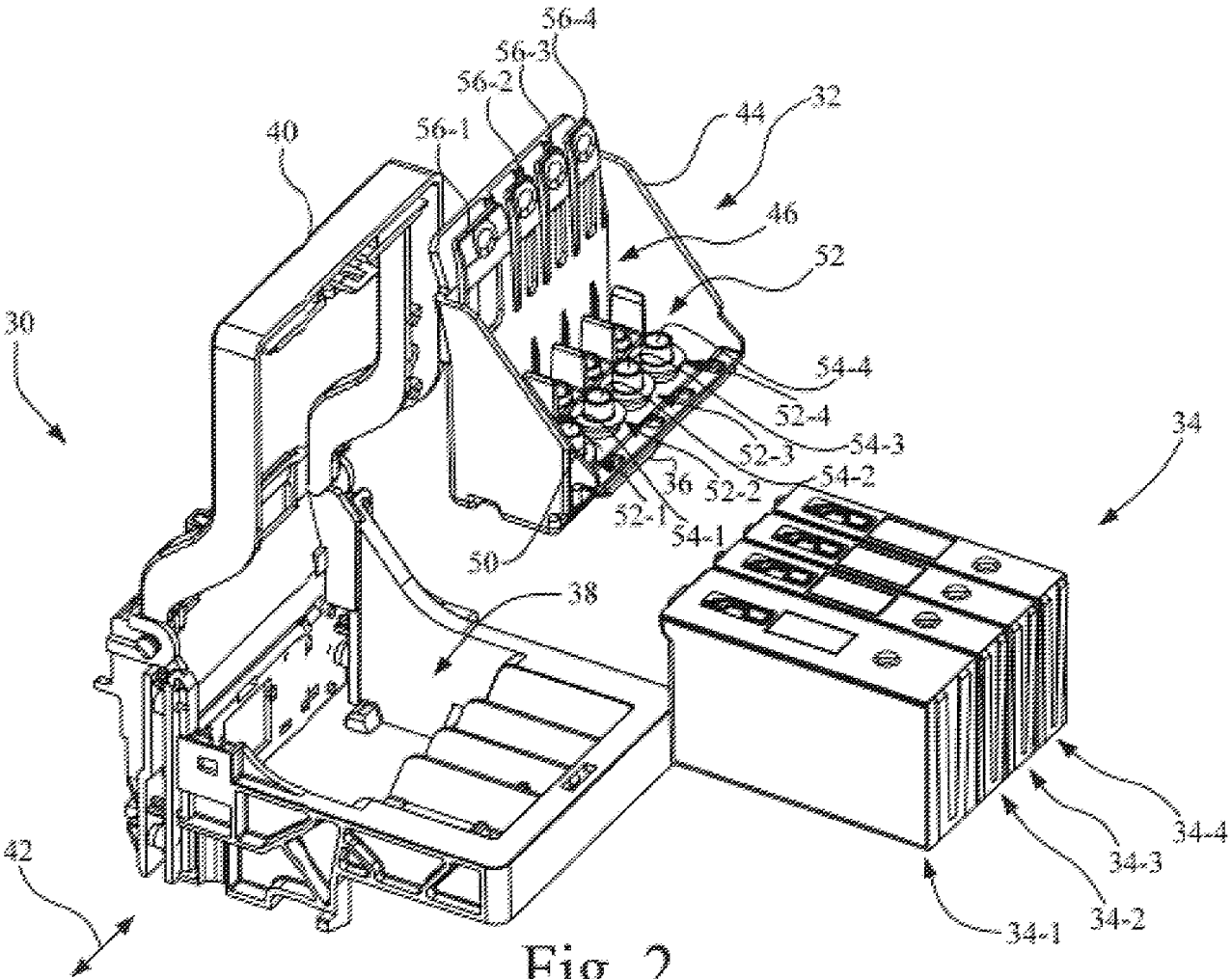
FIG. 2 is a perspective view of the printhead carrier of FIG. 1, with the printhead assembly and ink tanks uninstalled.

FIG. 2 shows in a perspective view printhead carrier 30, with a printhead assembly 32 and a plurality of removable ink tanks 34 in an uninstalled state. Printhead carrier 30 is mechanically and electrically configured to mount and carry a printhead assembly 32 that includes at least one micro-fluid ejection chip 36. As is known in the art, micro-fluid ejection chip 36 includes a plurality of "chip vias", with each chip via forming an opening in the chip silicon that receives ink from a corresponding body via of a plurality of body vias formed in a printhead body, and each chip via directs the ink to a plurality of ink chambers, such as ink ejection chambers associated with a respective nozzle opening on a nozzle plate.

Referring to FIGS. 1 and 2, printhead assembly 32 is mounted into position to printhead carrier 30 by inserting printhead assembly 32 into a cavity 38 in printhead carrier 30, and is latched in position by a mounting lever 40. Printhead carrier 30 transports printhead assembly 32, and in turn ink jet micro-fluid ejection chip 36, in a reciprocating manner in a bi-directional main scan direction, i.e., axis, 42 over an image surface of the sheet of print media 28 during a printing operation.

Printhead assembly 32 is configured to mount and carry the plurality of removable ink tanks 34, and to facilitate an ink transfer from one or more of the plurality of removable ink tanks 34 to micro-fluid ejection chip 36. The plurality of removable ink tanks 34 may be made, for example, from plastic. The plurality of ink tanks 34 are individually identified as ink tanks 34-1, 34-2, 34-3 and 34-4, and may include a monochrome ink tank containing black ink, and three color ink tanks containing cyan, magenta, and yellow inks. Printhead assembly 32 includes a printhead body 44, which may be molded from plastic, and a latch plate 46 attached to printhead body 44.

Printhead body 44 includes an upper generally planar ceiling 50 to which a plurality of wick retainers 52 is attached. The plurality of wick retainers 52 are individually identified as wick retainer 52-1, wick retainer 52-2, wick retainer 52-3, and wick retainer 52-4. Each wick retainer 52-1, 52-2, 52-3, and 52-4 mounts a respective wick 54-1, 54-2, 54-3, and 54-4 that operably engages the respective ink output ports of ink tanks 34-1, 34-2, 34-3 and 34-4, respectively, to facilitate fluid communication between the ink output ports of ink tanks 34-1, 34-2, 34-3 and 34-4 and micro-fluid ejection chip 36. Each of wicks 54-1, 54-2, 54-3, and 54-4 may be constructed from a porous material, such as for example, from a porous felt material or a porous foam material. Ink tanks 34-1, 34-2, 34-3 and 34-4 are individually mounted to printhead assembly 32 by way of individual latches 56-1, 56-2, 56-3 and 56-4 of latch plate 46.

Figure 3:
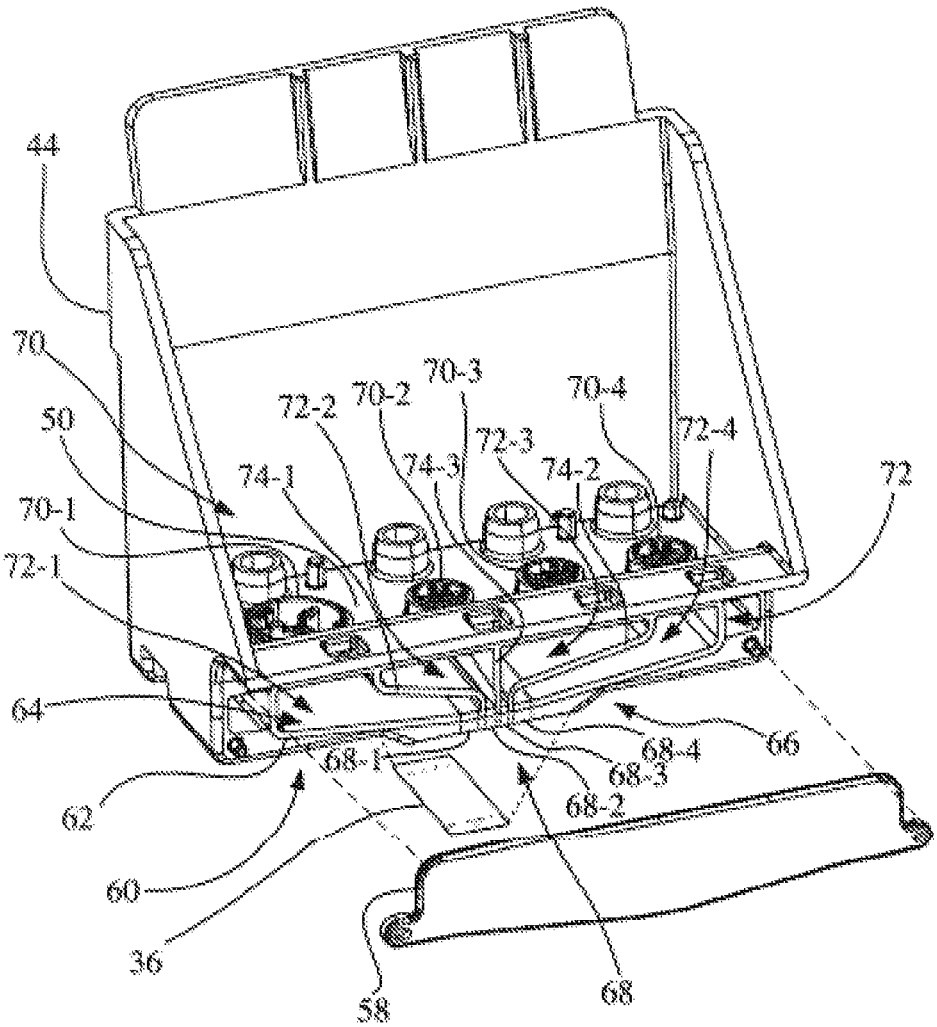
FIG. 3 is a side perspective view of the printhead body of the printhead assembly of FIG. 2, with the sealing cover uninstalled to expose vertically overlapping ink flow channels.

FIG. 3 shows one embodiment of printhead body 44, with a sealing cover 58 removed to expose a side opening 60. Upon final assembly of printhead body 44, sealing cover 58 is engaged with printhead body 44 at side opening 60 to cover over side opening 60, and is sealed over side opening 60 by a hermetic seal, such as for example, formed by an adhesive or by a welding operation.

Printhead body 44 includes a floor 62 vertically spaced apart from, i.e., positioned below, ceiling 50. Floor 62 has an interior side 64 and an exterior side 66. Exterior side 66 is configured for mounting micro-fluid ejection chip 36. Micro-fluid ejection chip 36 is mounted to printhead body 44 over a plurality of body vias (i.e., openings) 68, individually identified as body via 68-1, body via 68-2, body via 68-3 and body via 68-4. As used herein, a "body via" is an opening in the printhead body, e.g., printhead body 44, used to direct ink to a particular chip via of a particular micro-fluid ejection chip. In the present embodiment, the plurality of body vias 68 extend through floor 62 from interior side 64 to exterior side 66, and are positioned to supply ink to micro-fluid ejection chip 36.

Printhead body 44 has formed on ceiling 50 a plurality of filter towers 70, which are individually identified as filter tower 70-1, filter tower 70-2, filter tower 70-3, and filter tower 70-4. Each of the plurality of filter towers 70 is capped with a respective filter (not shown). Also, each filter tower mounts a respective wick retainer 52, and facilitates fluid communication with a respective one of the wicks 54 for receiving ink from a respective one of the ink tanks 34 (see FIG. 2).

Printhead body 44 has formed therein over floor 62, i.e., between ceiling 50 and floor 62, vertically overlapping ink flow channels 72, individually identified as ink flow channel 72-1, ink flow channel 72-2, ink flow channel 72-3, and ink flow channel 72-4, that are positioned to provide an ink flow path between filter towers 70-1, filter tower 70-2, filter tower 70-3, and filter tower 70-4 and any corresponding body vias, e.g., body via 68-1, body via 68-2, body via 68-3 and body via 68-4, respectively as shown in the embodiment of FIG. 3. Accordingly, each individual ink flow channel of the ink flow channels 72 is in fluid communication with at least one body via of the plurality of body vias 68. For example, ink flow channel 72-1 is in fluid communication with body via 68-1, ink flow channel 72-2 is in fluid communication with body via 68-2, ink flow channel 72-3 is in fluid communication with body via 68-3, and ink flow channel 72-4 is in fluid communication with body via 68-4. Each of ink flow channel 72-1, ink flow channel 72-2, ink flow channel 72-3, and ink flow channel 72-4 is a separate and independent ink flow channel, i.e., there is no cross-flow fluid communication between any two or more of ink flow channel 72-1, ink flow channel 72-2, ink flow channel 72-3, and ink flow channel 72-4. Also, in this embodiment, ink flow channel 72-1 is arranged to be generally parallel to ink flow channel 72-2, and ink flow channel 72-3 is arranged to be generally parallel to ink flow channel 72-4.

Ink flow channel 72-2 is vertically separated from ink flow channel 72-1 by a separation wall 74-1, and body via 68-1 is adjacent to body via 68-2. Ink flow channel 72-3 is vertically separated from ink flow channel 72-4 by a separation wall 74-2, and body via 68-3 is adjacent to body via 68-4. Ink flow channel 72-2 is separated from ink flow channel 72-3 by a vertical separation wall 74-3. Separation wall 74-1 is positioned to provide a roof over body via 68-1, and separation wall 74-2 is positioned to provide a roof over body via 68-4.

In the embodiment of FIG. 3, the vertically overlapping ink flow channels 72 includes a first set of vertically overlapping ink flow channels 72-1, 72-2 that is horizontally spaced from a second set of vertically overlapping ink flow channels 72-3, 72-4 by vertical separation wall 74-3. In this embodiment, vertically overlapping ink flow channels 72-1 and 72-2 are arranged symmetrical to vertically overlapping ink flow channels 72-3 and 72-4, with respect to vertical separation wall 74-3. The air storage volume of each of the plurality of ink flow channels 72 is large enough so that it can accommodate the volume of air that is accumulated for the expected life of printhead assembly 32.

Figure 4:
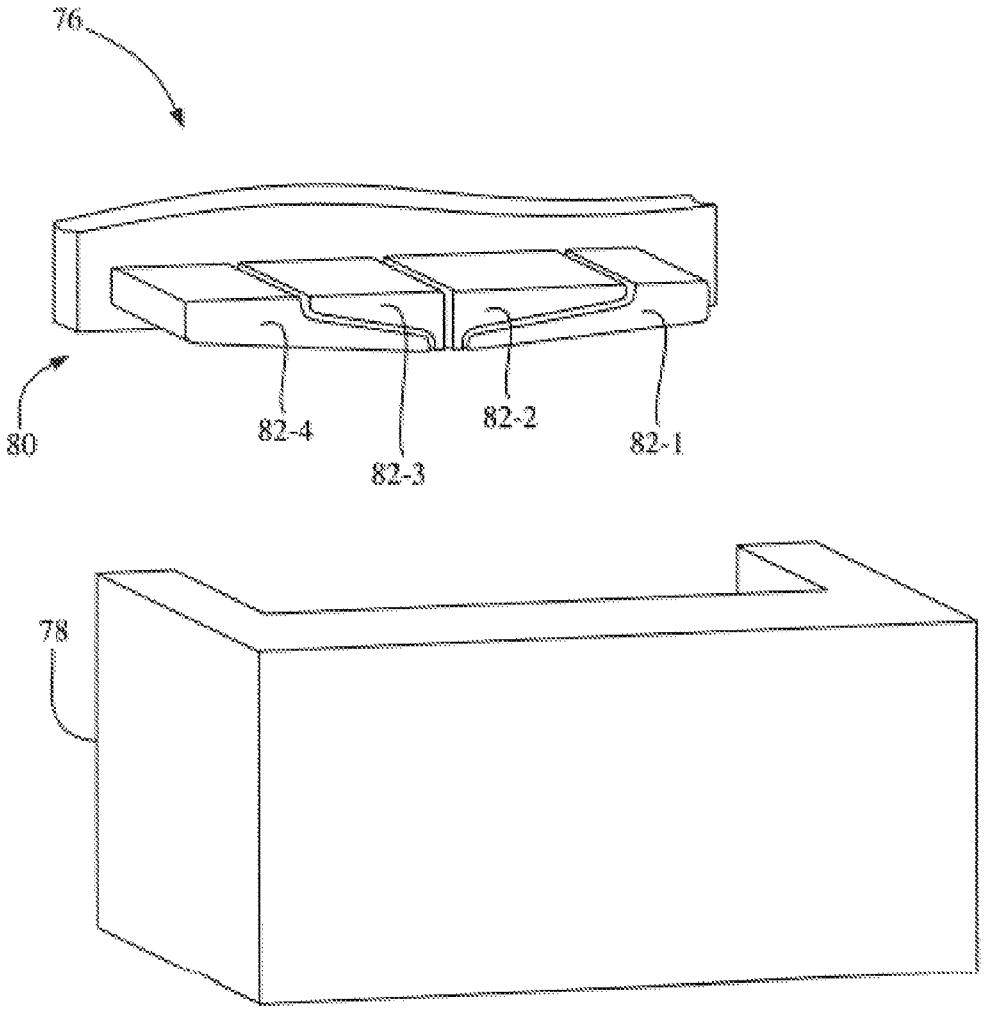
FIG. 4 is a perspective representation of a portion of a multi-piece mold used for molding the printhead body of FIG. 3.

FIG. 4 shows a portion of a multi-piece mold 76 that may be used in molding printhead body 44. Mold 76 includes, among other components, a cavity mold 78 and at least one slide mold 80. Slide mold 80 includes vertically overlapping slides 82-1, 82-2, 82-3 and 82-4 that correspond to the desired locations of vertically overlapping ink flow channels 72-1, 72-2, 72-3, and 72-4, respectively, in printhead body 44 of the embodiment shown in FIG. 3. The plurality of body vias 68 are formed from the bottom by corresponding protrusions (not shown) in cavity mold 78, and are shut off on the slides 82-1, 82-2, 82-3 and 82-4 that form the vertically overlapping ink flow channels 72-1, 72-2, 72-3, and 72-4. Likewise, filter towers 70 are molded from the top by the core side of the mold (not shown) and are also shut off by the slides 82-1, 82-2, 82-3 and 82-4.

In the embodiment shown in FIG. 4, the vertically overlapping ink flow channels 72-1, 72-2, 72-3 and 72-4 are formed using a slide pull of slide mold 80 in a single direction. In other embodiments, the vertically overlapping ink flow channels 72-1, 72-2, 72-3, and 72-4 may be formed using slide pulls from opposite directions, e.g., with one slide mold pulling from the front side of printhead body to form ink flow channels 72-1 and 72-4, and with another slide mold pulling from the back side of printhead body to form ink flow channels 72-2 and 72-3.

Figure 5A:
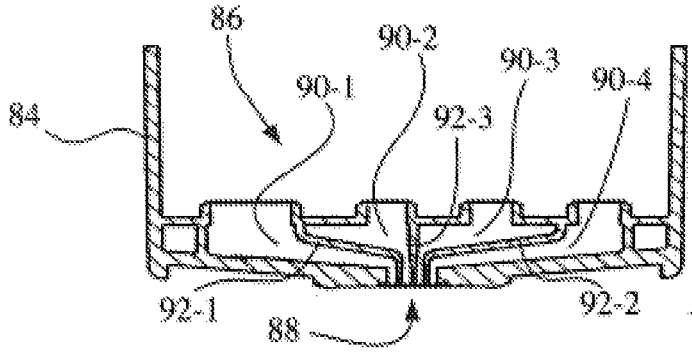
FIGS. 5A-5C are variations of the embodiment of FIG. 3 for supplying ink to a single micro-fluid ejection chip.
Figure 5B:
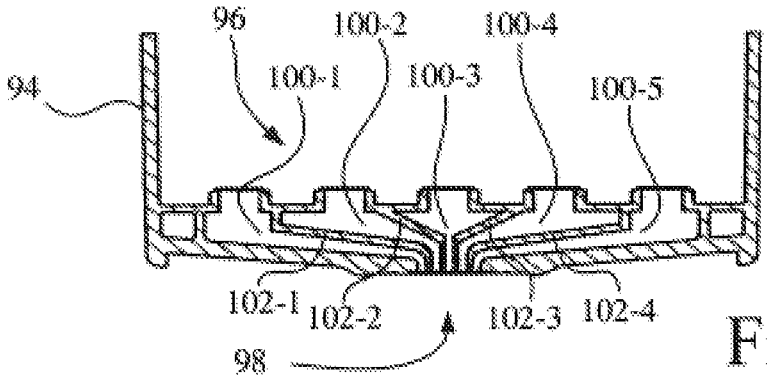
Figure 5C:
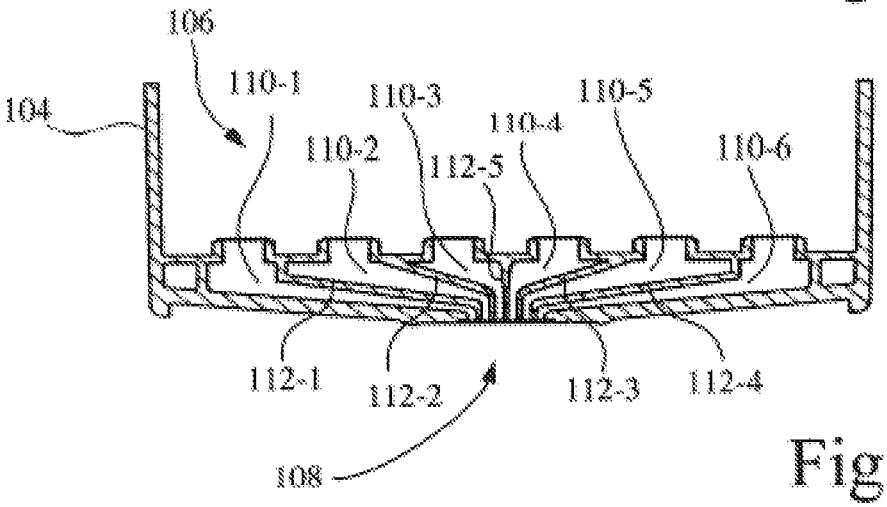

FIGS. 5A-5C are variations of the embodiment of FIG. 3 for supplying ink to a single micro-fluid ejection chip 36.

FIG. 5A is a sectioned side view of a printhead body 84 including four filter towers 86 and four body vias 88. Printhead body 84 also includes four vertically overlapping ink flow channels 90-1, 90-2, 90-3, and 90-4 facilitating fluid communication between respective filter towers 86 and body vias 88. Ink flow channel 90-1 is vertically separated from ink flow channel 90-2 by separation wall 92-1. Ink flow channel 90-3 is vertically separated from ink flow channel 90-4 by separation wall 92-2. In this embodiment, the length of separation wall 92-1 is shorter than separation wall 92-2. A vertical separation wall 92-3 separates ink flow channel 90-2 from ink flow channel 90-3.

FIG. 5B is a sectioned side view of a printhead body 94 including five filter towers 96 and five body vias 98. Printhead body 94 also includes five vertically overlapping ink flow channels 100-1, 100-2, 100-3, 100-4, and 100-5, arranged symmetrically. Vertically overlapping ink flow channels 100-1, 100-2, 100-3, 100-4 and 100-5 facilitate fluid communication between respective filter towers 96 and body vias 98. Ink flow channel 100-1 is separated from ink flow channel 100-2 by separation wall 102-1. Ink flow channel 100-2 is separated from ink flow channel 100-3 by separation wall 102-2. Ink flow channel 100-3 is separated from ink flow channel 100-4 by separation wall 102-3. Ink flow channel 100-4 is separated from ink flow channel 100-5 by separation wall 102-4.

FIG. 5C is a sectional side view of a printhead body 104 including six filter towers 106 and six body vias 108. Printhead body 104 also includes six vertically overlapping ink flow channels 110-1, 110-2, 110-3, 110-4, 110-5, 110-6, arranged symmetrically. Vertically overlapping ink flow channels 110-1, 110-2, 110-3, 110-4, 110-5 and 110-6 facilitate fluid communication between respective filter towers 106 and body vias 108. Ink flow channel 110-1 is separated from ink flow channel 110-2 by separation wall 112-1. Ink flow channel 110-2 is separated from ink flow channel 110-3 by separation wall 112-2. Ink flow channel 110-4 is separated from ink flow channel 110-5 by separation wall 112-3. Ink flow channel 110-5 is separated from ink flow channel 110-6 by separation wall 112-4. A vertical separation wall 112-5 separates ink flow channel 110-3 from ink flow channel 110-4.

Figure 6A:
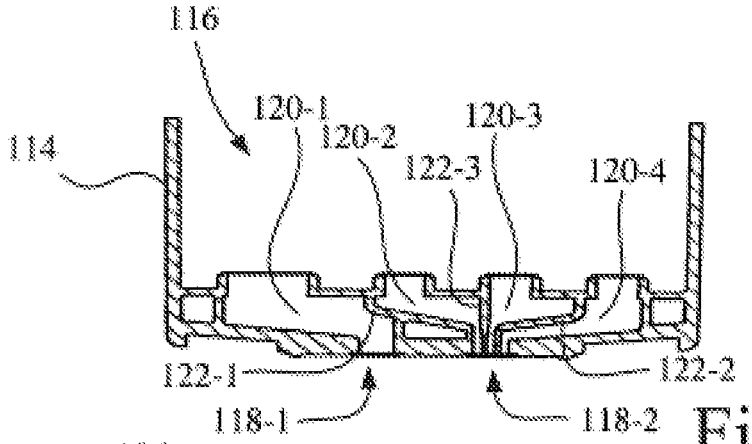
FIGS. 6A-6C are variations of the embodiment of FIG. 3 for supplying ink to multiple micro-fluid ejection chips.
Figure 6B:
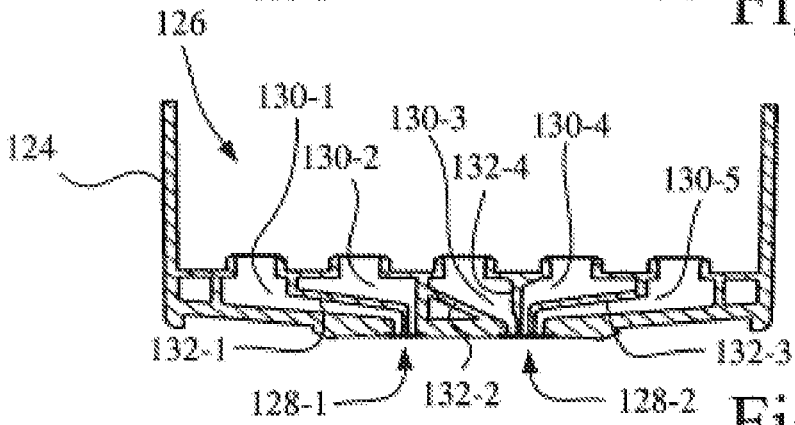
Figure 6C:
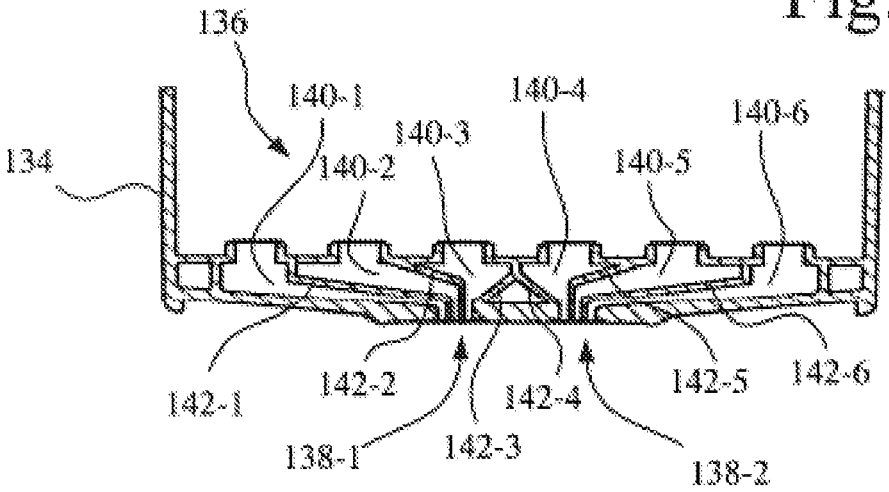

FIGS. 6A-6C are variations of the embodiment of FIG. 3 for supplying ink to multiple, e.g., two, micro-fluid ejection chips 36.

FIG. 6A is a sectioned side view of a printhead body 114 including four filter towers 116, a body via 118-1 for supplying ink to a first micro-fluid ejection chip 36 and a set of three body vias 118-2 for supplying ink to a second micro-fluid ejection chip 36. Printhead body 114 includes four vertically overlapping ink flow channels 120-1, 120-2, 120-3, and 120-4, with a first ink flow channel 120-1 facilitating fluid communication between the respective filter tower 116 and the respective body via 118-1, and a second set of ink flow channels 120-2, 120-3, and 120-4 facilitating fluid communication between respective filter towers 116 and the respective set of body vias 118-2. Ink flow channel 120-1 is separated from ink flow channel 120-2 by separation wall 122-1. Ink flow channel 120-3 is separated from ink flow channel 120-4 by separation wall 122-2. Ink flow channel 120-2 is separated from ink flow channel 120-3 by a vertical separation wall 122-3.

FIG. 6B is a sectioned side view of a printhead body 124 including five filter towers 126, a set of two body vias 128-1 for supplying ink to a first micro-fluid ejection chip 36, and a set of three body vias 128-2 for supplying ink to a second micro-fluid ejection chip 36. Printhead body 124 includes five vertically overlapping ink flow channels 130-1, 130-2, 130-3, 130-4, and 130-5, with a first set of ink flow channels 130-1 and 130-2 facilitating fluid communication between respective filter towers 126 and the respective set of body vias 128-1, and a second set of ink flow channels 103-3, 130-4, and 130-5 facilitating fluid communication between respective filter towers 126 and the respective set of body vias 128-2. Ink flow channel 130-1 is separated from ink flow channel 130-2 by separation wall 132-1. Ink flow channel 130-2 is separated from ink flow channel 130-3 by separation wall 132-2. Ink flow channel 130-4 is separated from ink flow channel 130-5 by separation wall 132-3. Ink flow channel 130-3 is separated from ink flow channel 130-4 by a vertical separation wall 132-4.

FIG. 6C is a sectioned side view of a printhead body 134 including six filter towers 136, a set of three body vias 138-1 for supplying ink to a first micro-fluid ejection chip 36, and a set of three body vias 138-2 for supplying ink to a second micro-fluid ejection chip 36. Printhead body 134 includes six vertically overlapping ink flow channels 140-1, 140-2, 140-3, 140-4, 140-5 and 140-6, with a first set of ink flow channels 140-1, 140-2, and 140-3 facilitating fluid communication between respective filter towers 136 and the respective set of body vias 138-1, and a second set of ink flow channels 140-4, 140-5, and 140-6 facilitating fluid communication between respective filter towers 136 and the respective set of body vias 138-2. Ink flow channel 140-1 is vertically separated from ink flow channel 140-2 by separation wall 142-1. Ink flow channel 140-2 is vertically separated from ink flow channel 140-3 by separation wall 142-2. Ink flow channel 140-3 is separated from ink flow channel 140-4 by separation walls 142-3 and 142-4. Ink flow channel 140-4 is vertically separated from ink flow channel 140-5 by separation wall 142-5. Ink flow channel 140-5 is vertically separated from ink flow channel 140-6 by separation wall 142-6.

Figure 7:
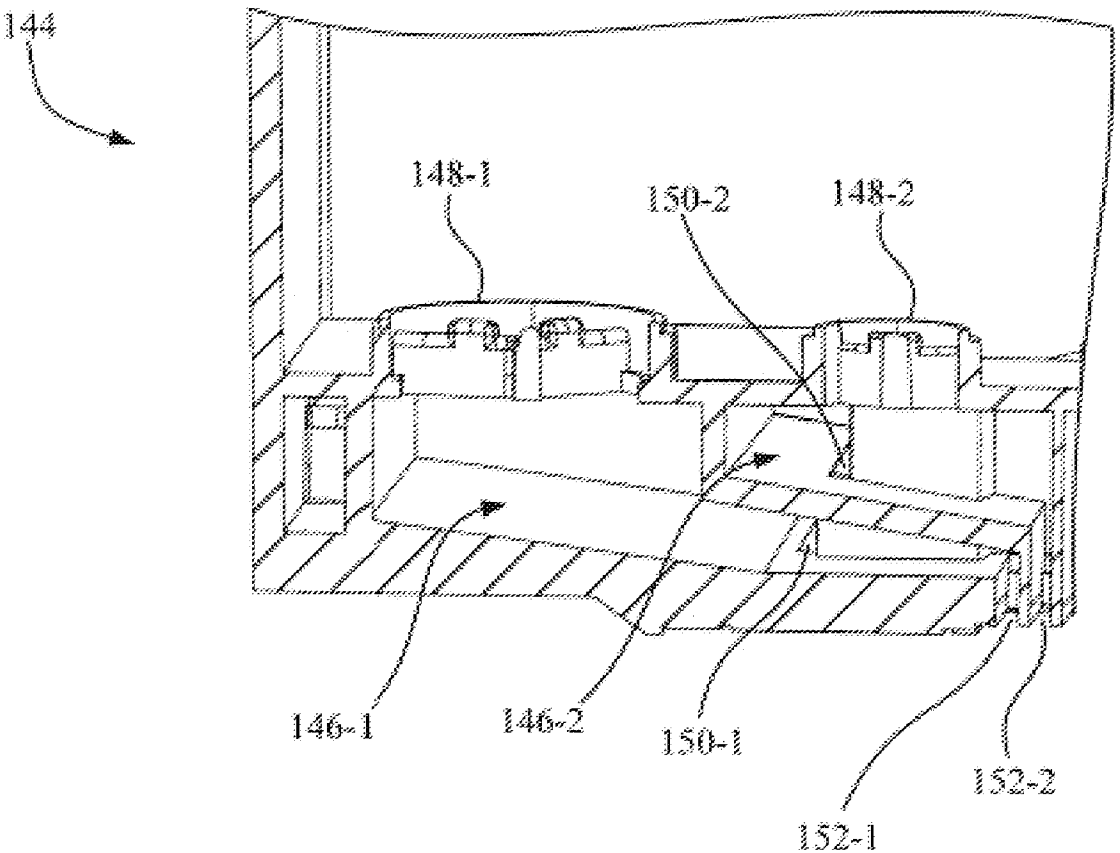
FIG. 7 shows a portion of a printhead body that illustrates how vertically overlapping ink flow channels may be configured to permit each ink flow channel to service multiple body vias in the printhead body.

FIG. 7 shows a portion of a printhead body 144 that illustrates how vertically overlapping ink flow channels may be configured to permit each ink flow channel to service multiple body vias in printhead body 144, such as for example, when supplying ink from one ink tank to two micro-fluid ejection chips 36. In the embodiment of FIG. 7, printhead body 144 includes at least two vertically overlapping ink flow channels 146-1 and 146-2. Ink is supplied to ink flow channel 146-1 by way of a filter tower 148-1. Likewise, ink is supplied to ink flow channel 146-2 by way of a filter tower 148-2. Printhead body 144 includes a first set of body vias, including body vias 150-1 and 150-2 for supplying ink to a first micro-fluid ejection chip 36, and includes a second set of body vias, including body vias 152-1 and 152-2 for supplying ink to a second micro-fluid ejection chip 36. Ink flow channel 146-1 is in fluid communication with two body vias 150-1 and 152-1. Ink flow channel 146-2 is in fluid communication with two body vias 150-2 and 152-2.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A printhead body for mounting a micro-fluid ejection chip, comprising:

a floor having an interior side and an exterior side, said exterior side being configured for mounting at least two micro-fluid ejection chips;

a plurality of body vias extending through said floor from said interior side to said exterior side, said plurality of body vias being positioned to supply ink to said at least two micro-fluid ejection chips; and a plurality of ink flow channels formed over said interior side of said floor, said plurality of ink flow channels including at least a first ink flow channel vertically overlapping a separate and independent second ink flow channel, wherein each individual ink flow channel of said plurality of ink flow channels is in fluid communication with at least one body via of said plurality of body vias, and wherein at least one of said plurality of ink flow channels is in fluid communication with at least two of said at least two micro-fluid ejection chips.

2. The printhead body of claim 1, wherein said first ink flow channel includes a first set of vertically overlapping ink flow channels horizontally spaced from said second ink flow channel that includes a second set of vertically overlapping ink flow channels.

3. The printhead body of claim 2, wherein each of said first set of vertically overlapping ink flow channels and said second set of vertically overlapping ink flow channels include an equal number of ink flow channels.

4. The printhead body of claim 3, wherein said equal number is at least two.

5. The printhead body of claim 2, wherein the number of ink flow channels in said first set of vertically overlapping ink flow channels differs from the number of ink flow channels in said second set of vertically overlapping ink flow channels.

6. The printhead body of claim 1, further comprising:

at least one side opening exposing said plurality of ink flow channels to an exterior of said printhead body; and at least one sealing cover for engaging said printhead body at said at least one opening to cover over and seal said at least one side opening.

7. The printhead body of claim 1, wherein at least a portion of said plurality of ink flow channels is formed by at least one mold slide of a multi-piece mold during the molding of said printhead body.

8. The printhead body of claim 7, wherein said at least a portion of said plurality of ink flow channels is formed using slide pulls from opposite directions.

9. A printhead assembly for mounting to an imaging apparatus, comprising:

at least two micro-fluid ejection chips; and a printhead body to which said at least two micro-fluid ejection chips are mounted, said printhead body including:

a ceiling;

a floor spaced apart from said ceiling, said floor having an interior side and an exterior side, said exterior side being configured for mounting said at least two micro-fluid ejection chips;

a plurality of body vias extending through said floor from said interior side to said exterior side, said plurality of body vias being positioned to supply ink to said at least two micro-fluid ejection chips; and a plurality of ink flow channels formed over said interior side of said floor, said plurality of ink flow channels including at least a first ink flow channel vertically overlapping a separate and independent second ink flow channel, wherein each individual ink flow channel of said plurality of ink flow channels is in fluid communication with at least one body via of said plurality of body vias, and wherein at least one of said plurality of ink flow channels is in fluid communication with at least two of said at least two micro-fluid ejection chips.

10. The printhead assembly of claim 9, wherein said first ink flow channel includes a first set of vertically overlapping ink flow channels horizontally spaced from said second ink flow channel that includes a second set of vertically overlapping ink flow channels.

11. The printhead assembly of claim 10, wherein each of said first set of vertically overlapping ink flow channels and said second set of vertically overlapping ink flow channels include an equal number of ink flow channels.

12. The printhead assembly of claim 11, wherein said equal number is at least two.

13. The printhead assembly of claim 10, wherein the number of ink flow channels in said first set of vertically overlapping ink flow channels differs from the number of ink flow channels in said second set of vertically overlapping ink flow channels.

14. The printhead assembly of claim 9, further comprising:

at least one side opening exposing said plurality of ink flow channels to an exterior of said printhead body; and at least one sealing cover for engaging said printhead body at said at least one opening to cover over and seal said at least one side opening.

15. The printhead assembly of claim 9, wherein at least a portion of said plurality of ink flow channels is formed by at least one mold slide of a multi-piece mold during the molding of said printhead body.

16. The printhead assembly of claim 15, wherein said at least a portion of said plurality of ink flow channels is formed using slide pulls from opposite directions.

17. A method for manufacturing a printhead body, comprising molding into said printhead body a plurality of ink flow channels using a slide mold, said plurality of ink flow channels including at least a first ink flow channel vertically overlapping a separate and independent second ink flow channel, said plurality of ink flow channels being located to be in fluid communication with a plurality of body vias, wherein each individual ink flow channel of said plurality of ink flow channels is in fluid communication with at least one of said plurality of body vias formed in said printhead body, and wherein at least one of said plurality of body vias is in fluid communication with at least two micro-fluid ejection chips.

18. The method of claim 17, wherein each ink flow channel vertically overlapping a separate and independent ink flow channel is formed using a slide pull of said slide mold from one direction.

19. The method of claim 17, wherein at least a portion of said plurality of ink flow channels is formed using slide pulls from opposite directions.

* * * * *